US009739077B2

(12) United States Patent
Rice

(10) Patent No.: US 9,739,077 B2
(45) Date of Patent: Aug. 22, 2017

(54) LINEAR ROTATING LINK SWITCH ACTUATION

(71) Applicant: John R. Rice, New Baltimore, MI (US)

(72) Inventor: John R. Rice, New Baltimore, MI (US)

(73) Assignee: INTEVA PRODUCTS, LLC, Troy, MI (US)

( * ) Notice: Subject to any disclaimer, the term of this patent is extended or adjusted under 35 U.S.C. 154(b) by 465 days.

(21) Appl. No.: 13/768,229

(22) Filed: Feb. 15, 2013

(65) Prior Publication Data

US 2013/0214543 A1 Aug. 22, 2013

Related U.S. Application Data

(60) Provisional application No. 61/599,667, filed on Feb. 16, 2012.

(51) Int. Cl.

| | |
|---|---|
| ***E05C 3/16*** | (2006.01) |
| ***E05B 77/00*** | (2014.01) |
| ***E05B 81/14*** | (2014.01) |
| ***E05B 81/66*** | (2014.01) |
| *E05C 3/06* | (2006.01) |
| *E05B 81/06* | (2014.01) |
| *E05B 81/34* | (2014.01) |
| *E05B 85/02* | (2014.01) |
| *E05B 81/42* | (2014.01) |

(52) U.S. Cl.

CPC ..... *E05B 77/00* (2013.01); *E05B 81/14* (2013.01); *E05B 81/66* (2013.01); *E05B 81/06* (2013.01); *E05B 81/34* (2013.01); *E05B 81/42* (2013.01); *E05B 85/02* (2013.01); *Y10T 292/0946* (2015.04)

(58) Field of Classification Search

CPC ..... E05B 81/64; E05B 81/66; E05B 81/68; E05B 2045/064; E05B 2045/065; E05B 2045/0655; E05B 2045/0665; E05B 2045/067; E05B 2045/0675; E05B 2045/068; E05B 77/36; E05B 77/38; E05B 77/42; E05B 2015/1664; E05B 77/00; E05B 81/06; E05B 81/14; E05B 81/34; E05B 81/42; E05B 85/02

USPC .. 292/201, 216, DIG. 23, DIG. 56, DIG. 38, 292/DIG. 42, DIG. 43, DIG. 53, DIG. 57, 292/DIG. 64; 200/61.62, 61.67, 61.68

See application file for complete search history.

(56) References Cited

U.S. PATENT DOCUMENTS 4,814,557 A * 3/1989 Kato ..... 200/61.64
4,927,204 A * 5/1990 Asada ..... 292/216

(Continued)

FOREIGN PATENT DOCUMENTS

DE 19547582 A1 * 6/1997

*Primary Examiner* — Alyson M Merlino
(74) *Attorney, Agent, or Firm* — Cantor Colburn LLP

(57) ABSTRACT

A method and device for generating a signal includes a housing having a wall. A fork bolt is pivotally coupled to the housing and movable between an unlatched and a latched position. A detent lever is pivotally coupled to the housing and cooperates with the fork bolt. A flexible member is connected to the housing of the latch. Proximate to a free end of the flexible member is a protruding portion. A link has a first end rotationally coupled to the fork bolt and a second end arranged to move linearly between a first position and a second position. When the fork bolt is in an unlatch position, the second end of the link applies a rotational force to the flexible member.

20 Claims, 7 Drawing Sheets

(56) References Cited

U.S. PATENT DOCUMENTS

| | | | | | |
|---|---|---|---|---|---|
| 5,273,324 | A | * | 12/1993 | Kobayashi | 292/201 |
| 5,516,164 | A | * | 5/1996 | Kobayashi | 292/201 |
| 5,564,761 | A | * | 10/1996 | Mizuki et al. | 292/201 |
| 5,713,613 | A | * | 2/1998 | Honma et al. | 292/201 |
| 5,765,884 | A | * | 6/1998 | Armbruster | 292/216 |
| 6,076,868 | A | * | 6/2000 | Roger et al. | 292/201 |
| 6,264,253 | B1 | * | 7/2001 | Takaishi | 292/216 |
| 6,341,448 | B1 | * | 1/2002 | Murray et al. | 49/280 |
| 6,422,615 | B1 | * | 7/2002 | Roos et al. | 292/216 |
| 6,428,059 | B2 | * | 8/2002 | Kobayashi et al. | 292/216 |
| 6,886,869 | B2 | * | 5/2005 | Martinez et al. | 292/216 |
| 7,311,330 | B2 | * | 12/2007 | Kachouh | 280/756 |
| 2005/0001437 | A1 | * | 1/2005 | Brose | 292/216 |
| 2011/0254288 | A1 | * | 10/2011 | Gaucher | 292/240 |

* cited by examiner

LINEAR ROTATING LINK SWITCH ACTUATION

CROSS REFERENCE TO RELATED APPLICATIONS

This application claims the benefit of U.S. Provisional Patent Application Ser. No. 61/599,667 filed Feb. 16, 2012, the contents of which are incorporated herein by reference thereto.

TECHNICAL FIELD

Exemplary embodiments of the present invention relate generally to door, lift gate, glass window and movable panel latches and, more particularly, to latches for vehicles.

BACKGROUND

A vehicle frequently includes displaceable panels such as a door, hood, trunk lid, hatch and the like which are affixed for hinged or sliding engagement with a host vehicle body. Cooperating systems of latches and strikers are typically provided to ensure that such panels remain secured in their fully closed position when the panel is closed.

A latch typically includes a fork bolt that is pivoted between an unlatched position and a primary latched position when the door is closed to latch the door in the closed position. The fork bolt is typically held in the primary latched position by a detent lever that pivots between an engaged position and a disengaged position. The detent lever is spring biased into the engaged position and thus, holds the fork bolt in the primary latched position when in the engaged position and releases the fork bolt when it is moved to the disengaged position so that the door can be opened.

The fork bolt is pivoted to the primary latched position by a striker attached to, for example, an associated door jamb when the door is closed. Once in the primary latched position, the detent lever engages the fork bolt to ensure the assembly remains latched.

Some vehicles have power unlatching mechanisms that electrically release the door latch. These power unlatching mechanisms move the detent lever from the engaged position to the disengaged position such that the fork bolt can be rotated or pivoted to the unlatched position.

In current latch systems, it is desirable to use a switch or micro switch to detect the status of the latch in order to safely carry out a locking measure or initiate electrical opening after locking. Because the various applications requiring latches may differ significantly, it is desirable to have flexibility in the placement of the switch within the latch system.

SUMMARY OF THE INVENTION

In accordance with an exemplary embodiment of the present invention, a latch is provided including a housing having a wall. A fork bolt is pivotally coupled to the housing and movable between an unlatched and a latched position. A detent lever is pivotally coupled to the housing and cooperates with the fork bolt. A flexible member is connected or integral to the housing of the latch. Proximate to a free end of the flexible member is a protruding portion. A link has a first end rotationally coupled to the fork bolt and a second end arranged to move linearly between a first position and a second position. When the fork bolt is in an unlatch position, the second end of the link applies a rotational force to the flexible member.

According to another exemplary embodiment of the present invention, a method of creating a signal is provided including disengaging a detent lever from a fork bolt. The fork bolt is then rotated from a first position to a second position. A switch is activated by a flexible member causing the switch to create a signal.

According to yet another embodiment of the invention, a latch is provided including a housing having a wall and a flexible member. The flexible member has a distal end with an angled surface. A fork bolt is pivotally coupled to the housing and movable between an unlatched and a latched position. A detent lever is pivotally coupled to the housing and arranged to cooperate with the fork bolt. A link has a first end rotationally coupled to the fork bolt and a second end in slidable engagement with the wall. The link moves linearly between a first position and a second position in response to rotation of the fork bolt. When the fork bolt is in an unlatched position, the cam surface of the second link contacts the angled surface of the flexible member, causing the flexible member to rotate.

The above-described and other features and advantages of the present invention will be appreciated and understood by those skilled in the art from the following detailed description, drawings, and appended claims.

BRIEF DESCRIPTION OF THE DRAWINGS

Embodiments of the present invention will now be described, by way of example only, with reference to the accompanying drawings in which.

Although the drawings represent varied embodiments and features of the present invention, the drawings are not necessarily to scale and certain features may be exaggerated in order to illustrate and explain exemplary embodiments the present invention. The exemplification set forth herein illustrates several aspects of the invention, in one form, and such exemplification is not to be construed as limiting the scope of the invention in any manner.

DETAILED DESCRIPTION

Certain passenger vehicles are equipped with a rear vehicle storage compartment, commonly known as a trunk. The trunk is closed by a deck lid that is hinged to the vehicle body and swings open to provide access to the storage compartment. Similarly, other vehicles are equipped with a lift gate that allows access to the rear of the vehicle through a gate that is hinged at or near the roof line of a vehicle and opens upward. Other vehicles have sliding doors that run horizontally on a track between an opened and closed position. Each of the deck lid, lift gate or sliding door can be thought of as panels that allow access to the interior of the vehicle compartment. Compartment latches, enable each of these types of panels to be secured and closed.

A compartment latch, as shown, is useful for a side compartment, such as a passenger door of a vehicle. The latch can provide a signal that the compartment panel is open. However, the latch is applicable to any environment where the features of the various embodiments of the invention are desired. For example, the latch can be attached to a vehicle structure such that the fork bolt is moved between the open position and the closed position when a hood, door, window, lift gate, etc. is opened and closed and the fork bolt engages a striker (not shown) that is attached to the hood, door, window, lift gate, etc. Alternatively, the latch can be secured to the hood, door, window, lift gate, etc. and the striker may be secured to the vehicle body at an opening into which the hood, door, window, lift gate, etc. is received.

Figure 1:
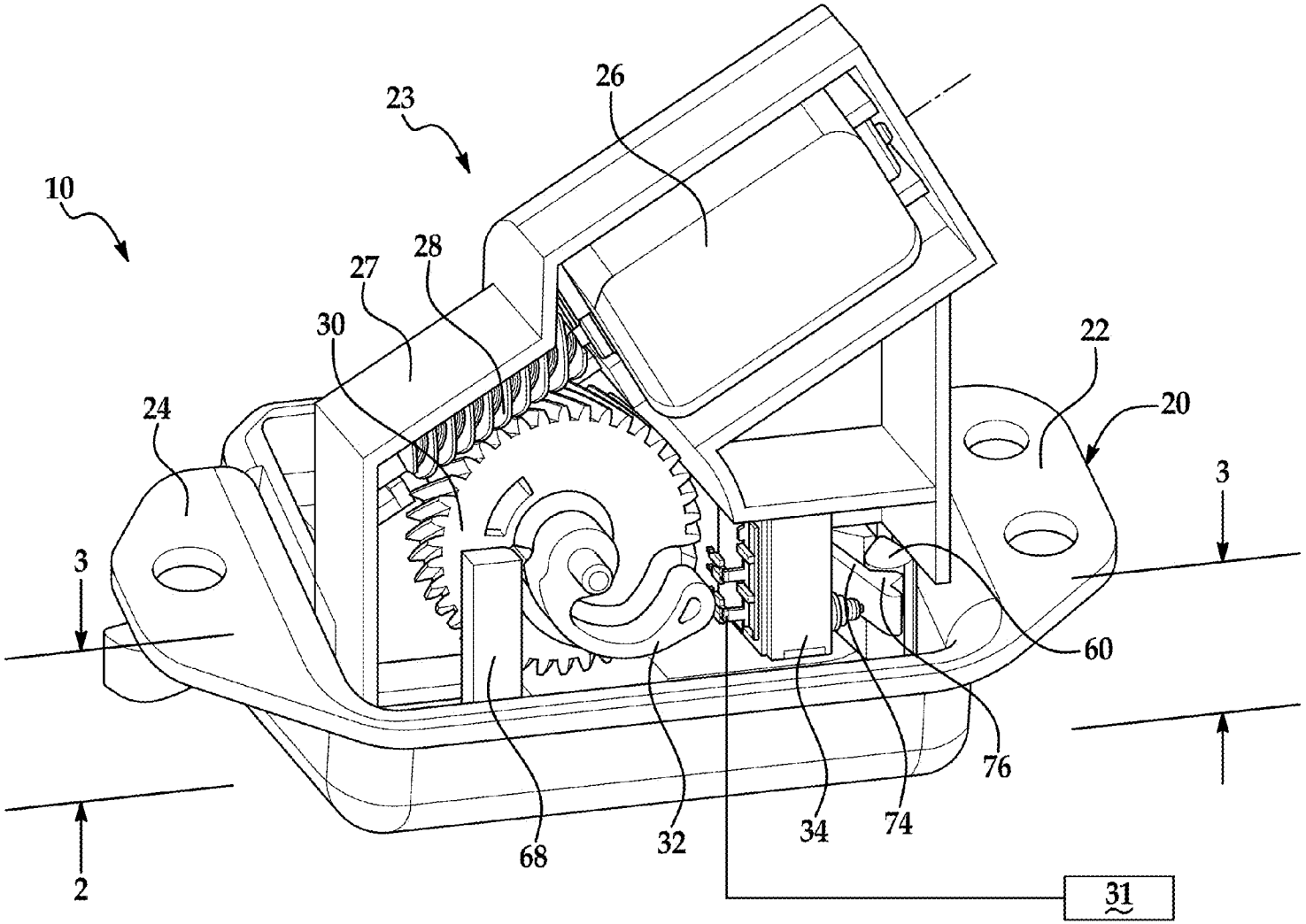
FIG. 1 is a perspective view of a latch in accordance with an exemplary embodiment of the present invention.
Figure 1A:
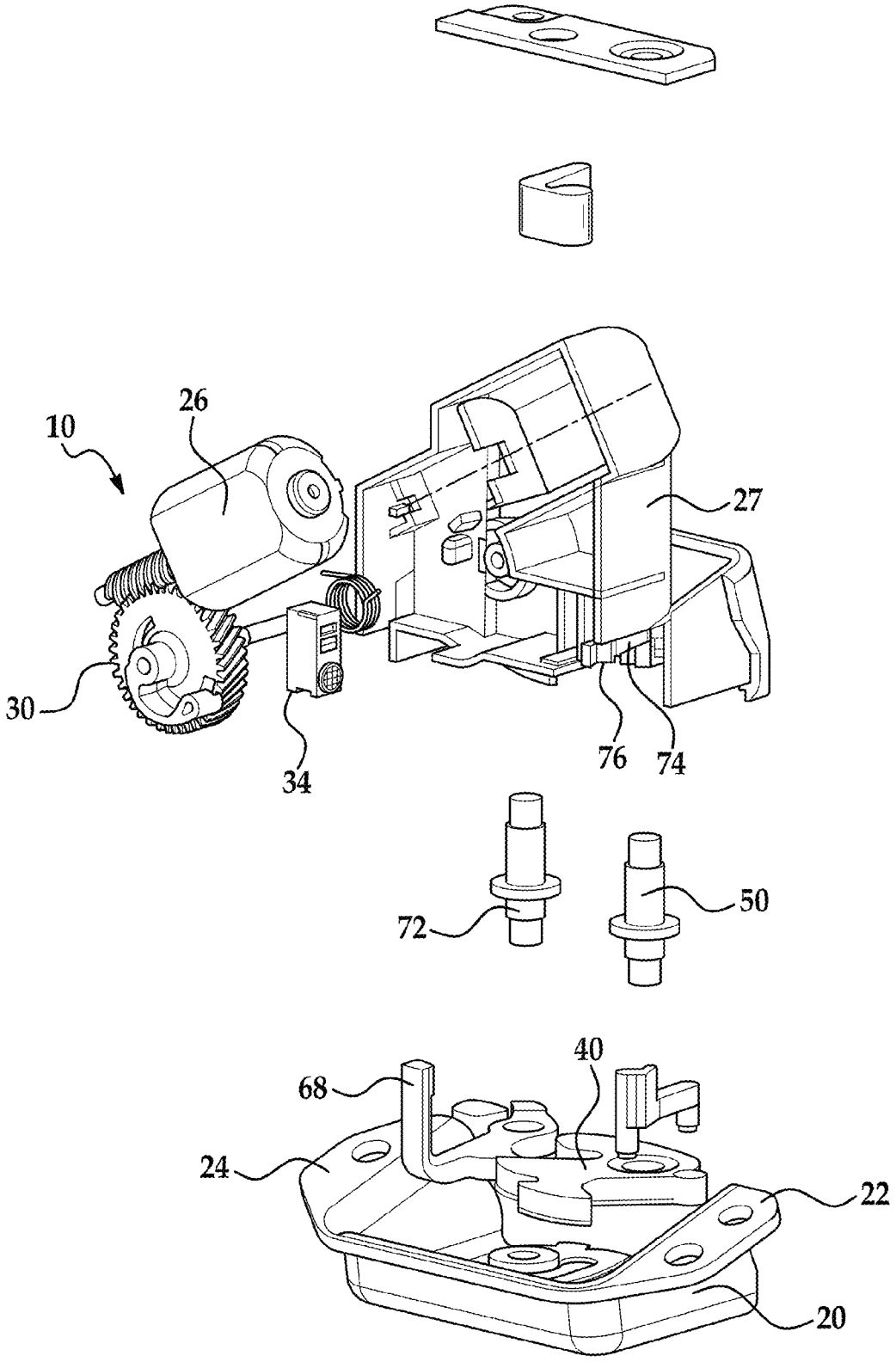
FIG. 1A is an exploded view of the latch illustrated in FIG. 1.
Figure 1B:
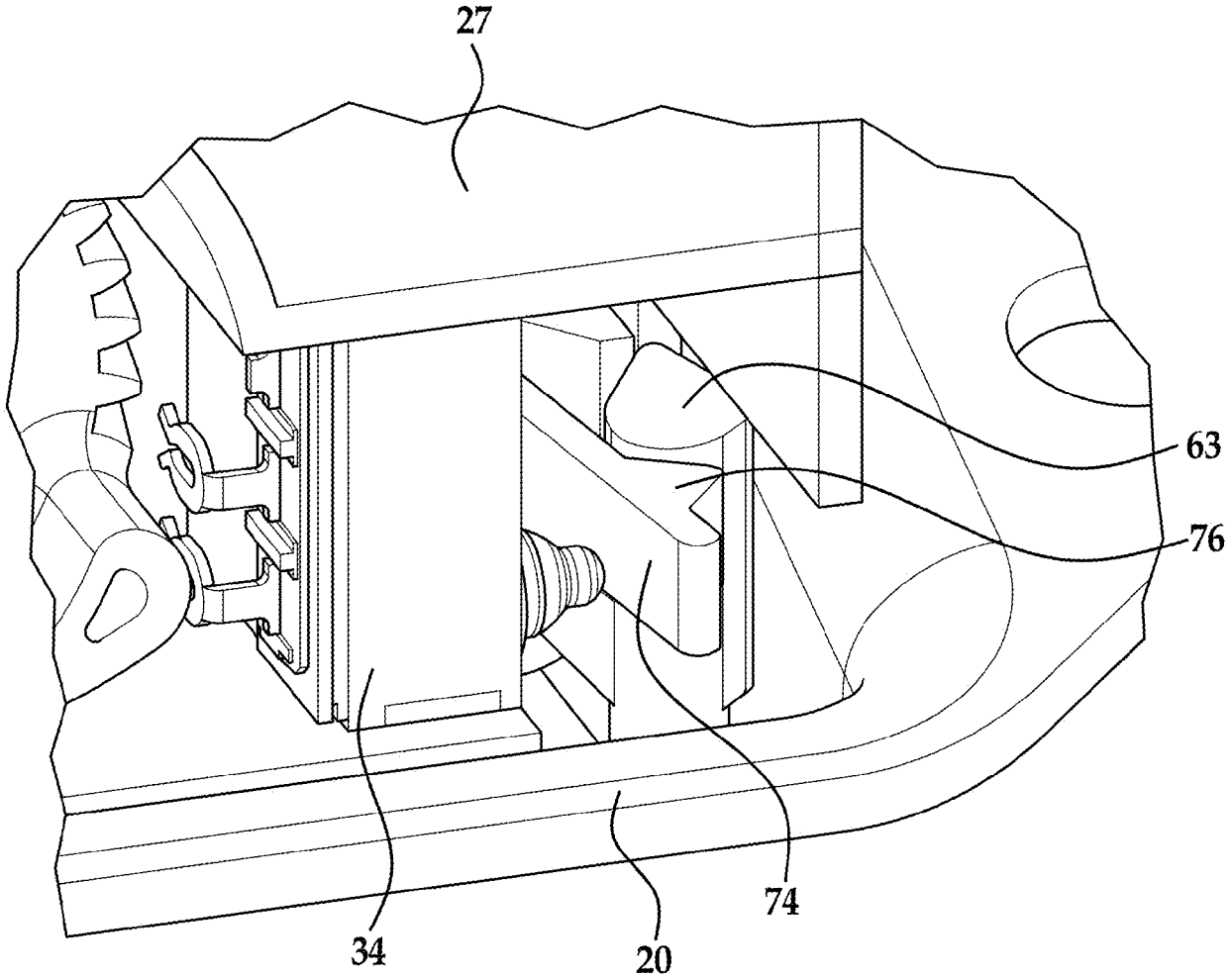
FIG. 1B is an enlarged view of a portion of the latch illustrated in FIG. 1.

Referring now to at least FIGS. 1-1B, latch 10, includes a first housing portion 20 having a first end 22 and a second end 24 for mounting the latch 10, for instance to a vehicle component such as a car door (not shown) and a second housing portion 27. The latch 10 also includes a release mechanism 23 having a motor 26 and a worm gear 28 coupled to the motor shaft. The worm gear 28 is additionally coupled to a rotary gear 30. Adjacent the rotary gear 30 is a switch 34 capable of generating a signal, such as a signal that the latch is open for example. In one non-limiting embodiment, switch 34 is operatively coupled to a controller or microcontroller 31 (illustrated schematically) of a vehicle latch 10 is used in. Thus, the switch 34 can provide a signal to the controller or microcontroller 31.

Figure 2:
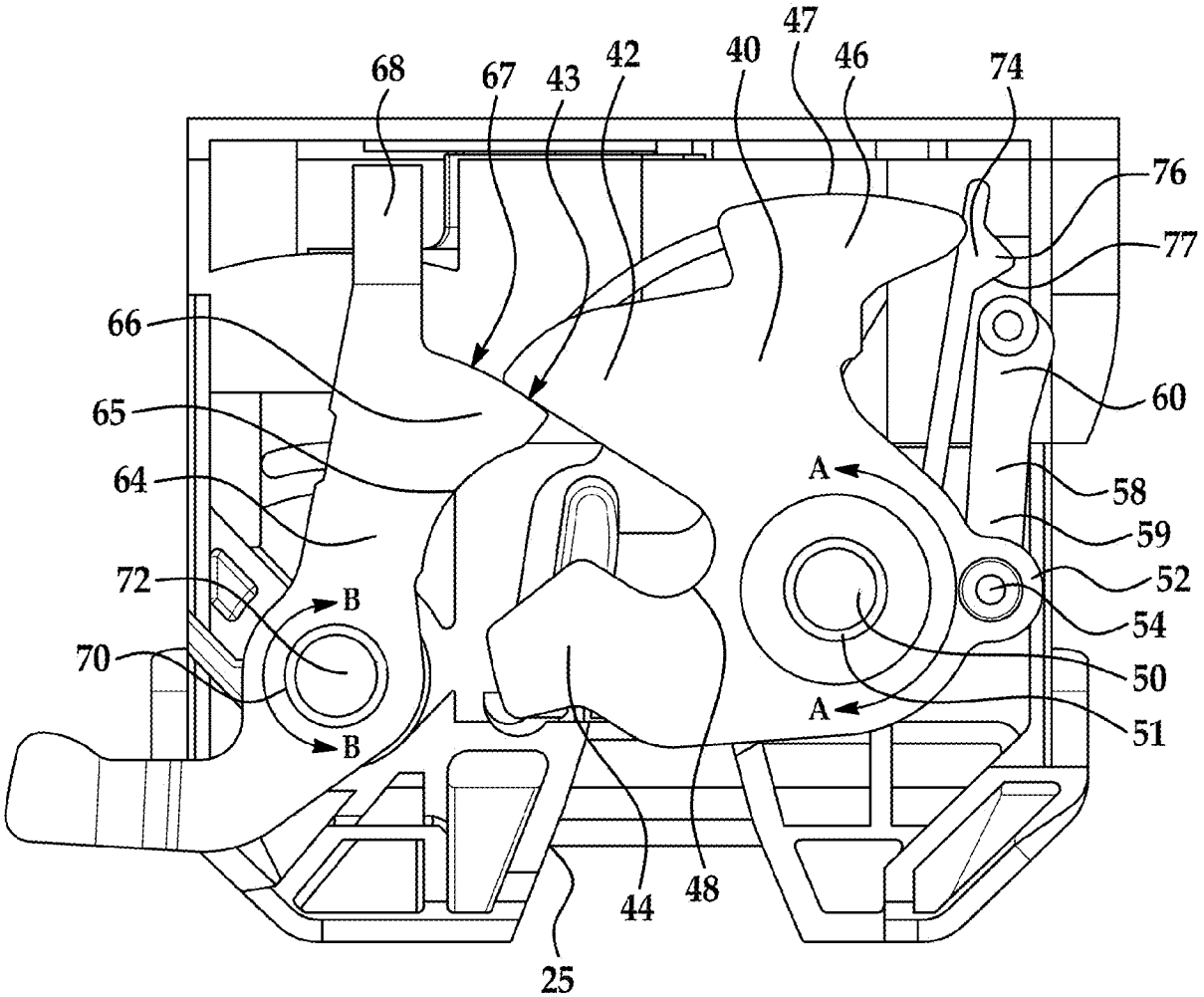
FIG. 2 is top view along lines 2-2 of FIG. 1.

Referring to FIG. 2, the latch is shown from another side. The latch 10 includes a fork bolt 40 and a detent lever 64 each being pivotally mounted to the latch housing 20. Fork bolt 40 is capable of rotation about a first stud 50 in the directions illustrated by arrows A, while the detent lever 64 is a capable of rotation about a second stud 72 in the directions illustrated by arrows B. A striker (not shown) is attached to a second complementary vehicle component (not shown), such as the vehicle structure, and is adapted to engage the fork bolt 40 to cause latching of the trunk lid or first element to the vehicle body. In an exemplary embodiment, the fork bolt 40 is biased towards an open position by a first coil spring positioned around stud 50, and the detent lever 64 is biased into engagement with the fork bolt 40 by a second coil spring positioned around stud 72.

Fork bolt 40 has a first shoulder 42, and a second shoulder 44 disposed on opposite sides of throat 48 that receives a striker. The housing 20 of the latch 10 has an opening 25 complementary to throat 48 for receiving the striker in the fork bolt 40. Fork bolt 40 additionally includes a third shoulder 46 that contacts a surface 65 of the detent lever 64 when rotating between a latched and an unlatched position, and a fourth shoulder 52 located adjacent the stud 50 opposite the throat 48. The detent lever 64 has a shoulder 66 for engagement with a shoulder of the fork bolt 40. The detent lever 64 additionally includes an end 68 that extends perpendicularly from the surface of the detent lever 64 for engagement with the release mechanism 23.

When the fork bolt 40 rotates between a latched and an unlatched position, a contact surface 47 of the third shoulder 46 of the fork bolt 40, slidably engages a complementary engagement surface 65 of the detent lever 64. Once the fork bolt 40 reaches the closed position, the detent lever 64 is spring biased into contact with the fork bolt 40 such that the fork bolt 40 cannot rotate into the open position unless the detent lever 64 is mechanically released or disengaged. When the fork bolt is latched and the detent lever is engaged with the fork bolt 40, surface 67 of the detent lever's 64 shoulder 66 contacts surface 43 of the fork bolt's first shoulder 42. In this latched position, a striker (not shown) is captured within the throat 48 of the fork bolt 40. In an alternate embodiment, the fork bolt 40 may have an additional fifth shoulder disposed between the first shoulder 42 and the third shoulder 46. Once the striker (not shown) engages the throat 48 of the fork bolt 40, the fork bolt rotates until the surface 67 of detent lever 64 engages this additional fifth shoulder, thereby securing the fork bolt 40 in a known safety position.

To open the latch, actuation of the release mechanism 23 engages end 68 of the detent lever 64 to move the detent lever 64 out of engagement with the fork bolt 40. As the motor 26 rotates the motor shaft, the worm gear 28 coupled to the shaft rotates. Because the worm gear 28 also engages the rotary gear 30, driving the motor causes the rotary gear 30 to rotate. A cam surface 32 extends perpendicularly from the planar surface of gear 30. As the rotary gear 30 rotates, the cam surface 32 contacts the end 68 of the detent lever 64 extending perpendicularly from the surface of the detent lever 64. The cam surface 32 exerts a force on the end 68 opposite the biasing force of spring 70 causing the detent lever 64 to rotate to a disengaged position away from fork bolt 40.

Figure 3:
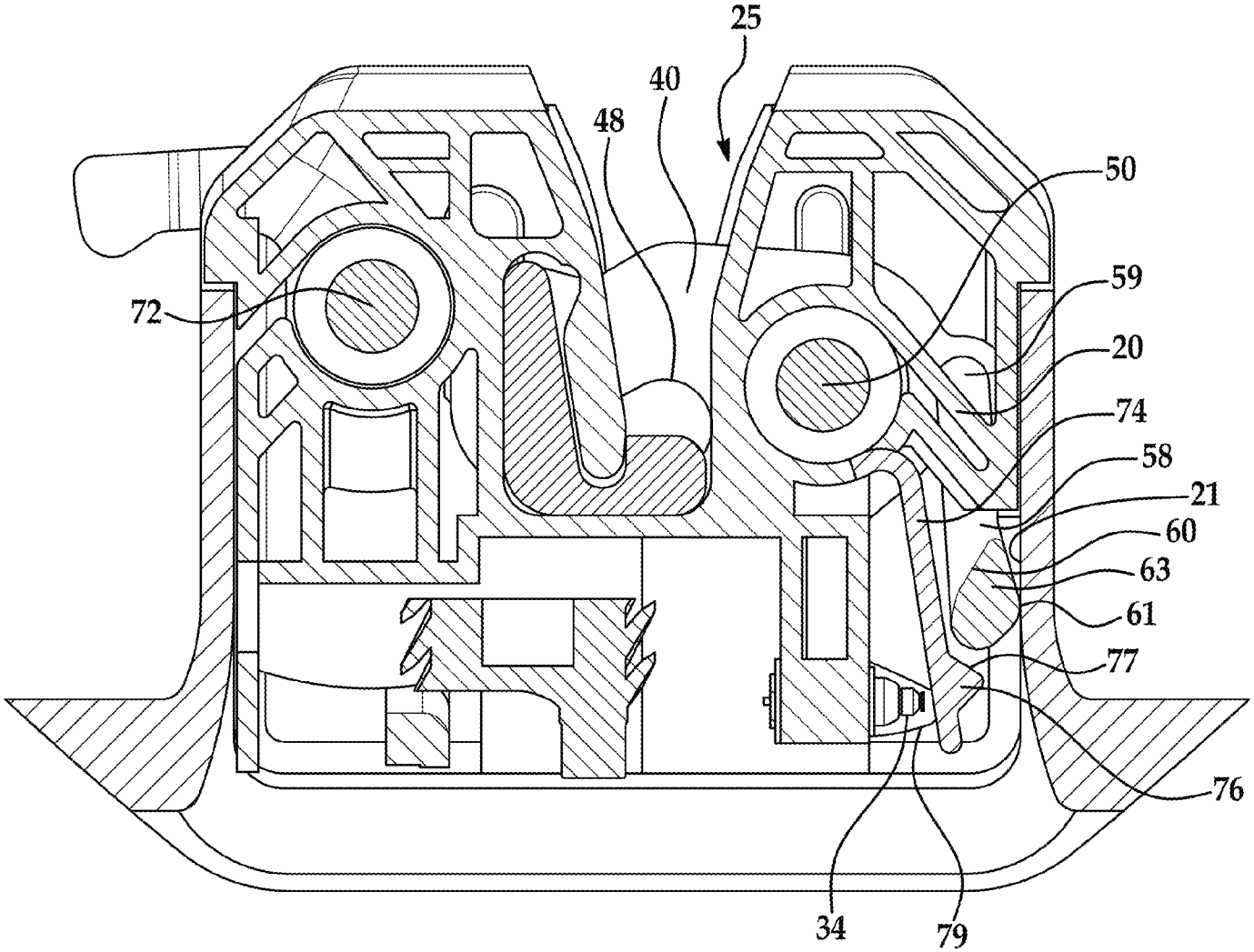
FIG. 3 is a view along lines 3-3 of FIG. 1 when the latch is in a closed position.
Figure 4:
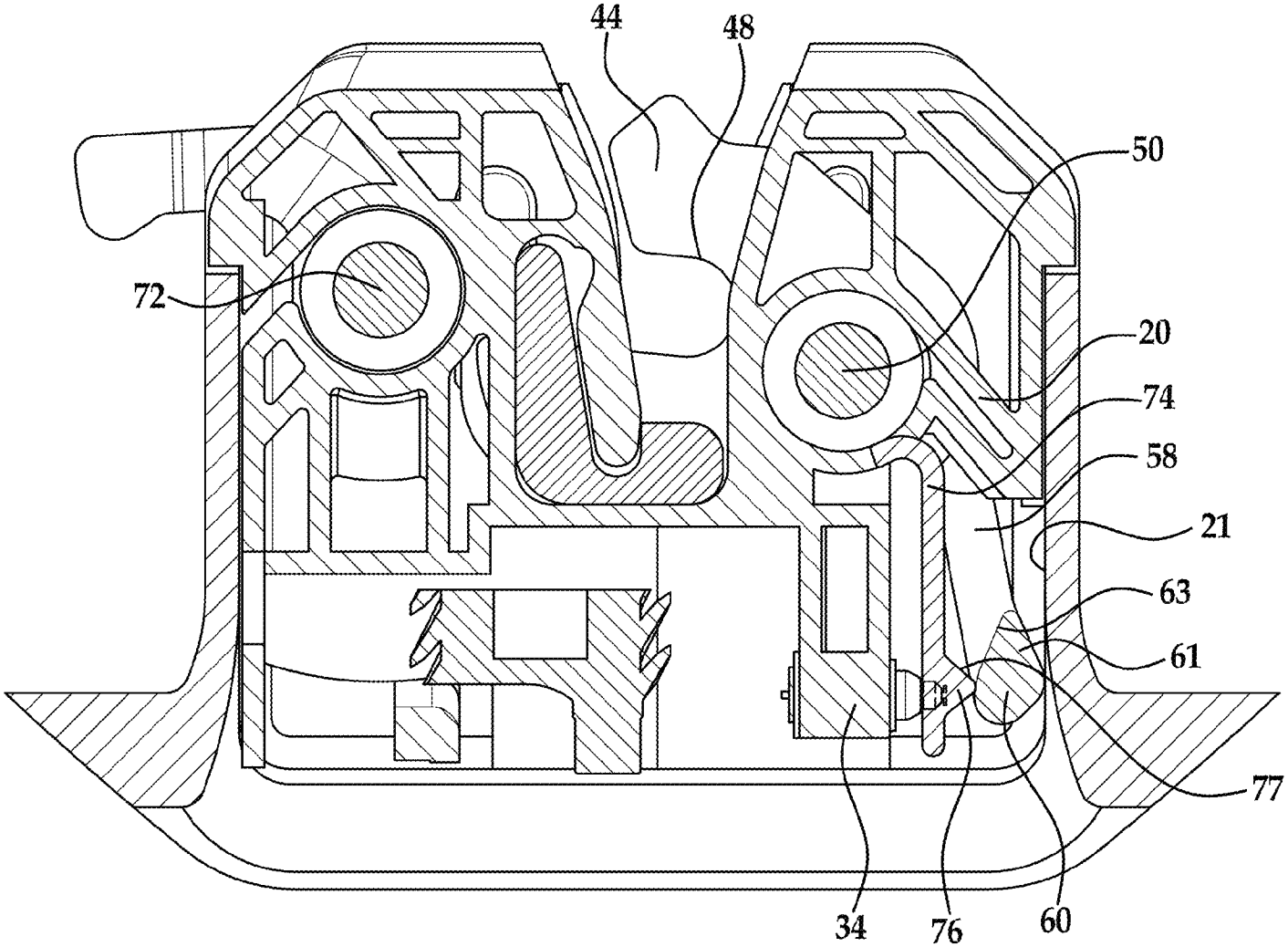
FIG. 4 is a view along lines 3-3 of FIG. 1 as the rotates between an engaged and a disengaged position.
Figure 5:
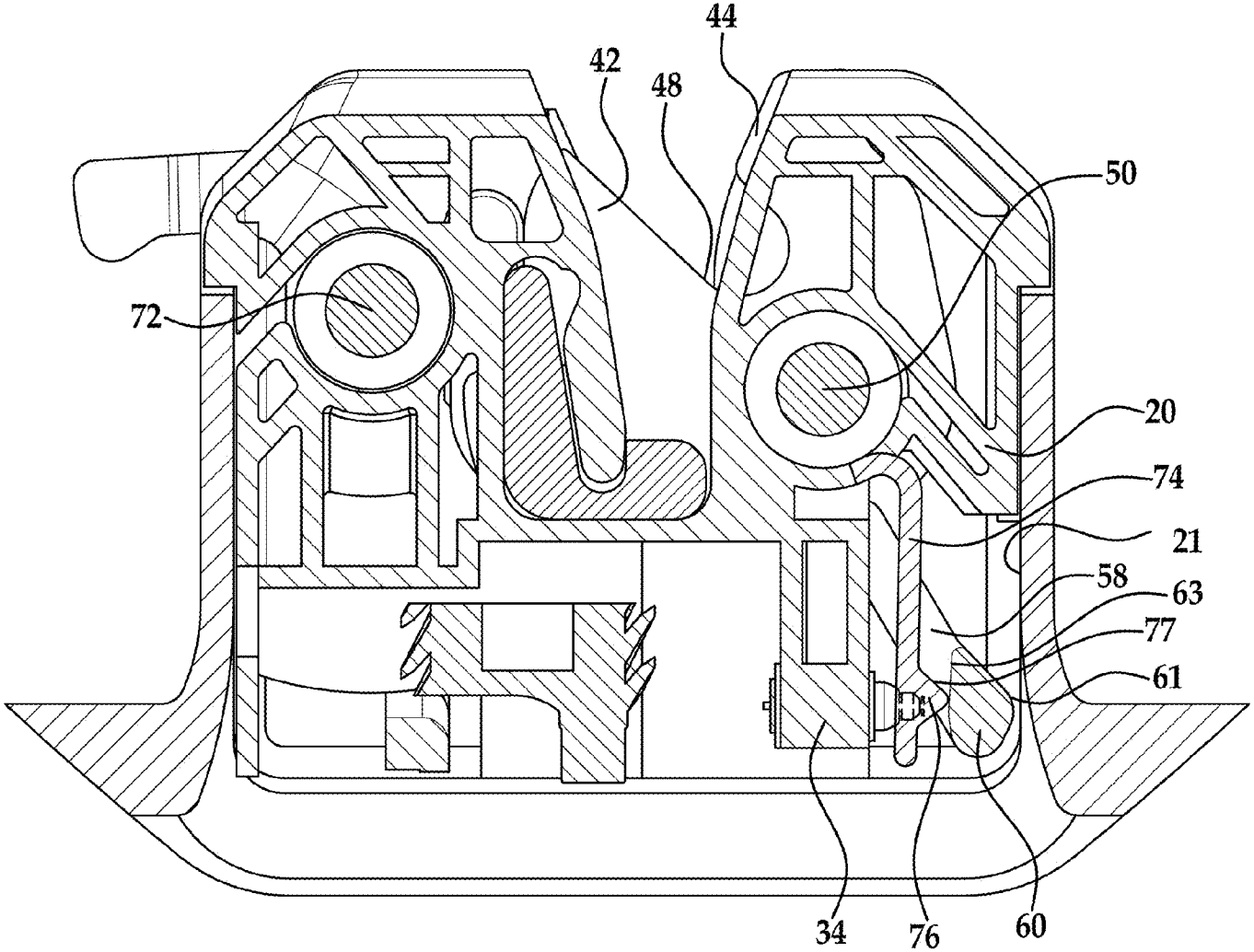
FIG. 5 is a view along lines 3-3 of FIG. 1 when the latch is in an open position.

Referring now to FIGS. 3-5, a flexible member 74 extends at an angle from a portion of the housing 27 such that the free end of the flexible member 74 is adjacent the switch 34. In the exemplary embodiment, the flexible member 74 is formed as an integral part of one the housing portions 20 or 27. In one non-limiting exemplary embodiment, flexible member 74 is integrally molded with the housing portion. Alternatively, the flexible member 74 is separately attached thereto. Of course, configurations and attachment methods are contemplated to be within the scope of the present invention and any suitable location is contemplated for flexible member 74. The flexible member 74 may be made of a resilient material such as plastic or any other equivalent materials such that the flexible member 74 is biased into a first position wherein the flexible member 74 does not contact switch 34 and can be moved to a second position wherein the flexible member contacts and actuates switch 34 by a force and upon removal of that force the resilient characteristics of flexible member 74 cause the same to return to the first position. Accordingly and in one non-limiting embodiment, a living hinge may be provided via flexible member 74. In one exemplary embodiment, the housing portion and the flexible member 74 is formed of a plastic or other equivalent easily molded material or equivalents thereof that is integrally molded with the housing for example at the same time the housing is formed. Alternatively, the housing arm may be inserted molded into the housing or still in another alternative fixed to the housing separately. In yet another embodiment, the flexible member 74 and the housing may be formed from different materials to provide varying characteristics, regardless of whether the flexible member 74 is integrally molded or formed with the housing, insert molded are separately attached. Although exemplary embodiments are directed to a plastic housing and housing arm other equivalent materials are considered to be with the scope of various embodiments of the invention. Proximate to the free end of the flexible member 74 is a protruding portion 76. In an exemplary embodiment, the protruding portion 76 includes at least one angled surface 77.

A link 58 is rotationally connected at a first end 59 to a fourth shoulder 52 of the fork bolt 40 by a pin 54. The link 58 extends in the direction of the flexible member 74, adjacent a wall 21 of the housing 20, such that a second end 60 of the link 58 is near angled surface 77 of protruding portion 76. In one embodiment, the second end 60 of the link 58 is larger and more rounded than the first end 59. In the exemplary embodiment, the second end includes a contact surface 61 and an opposing cam surface 63. Because the first end 59 of the link 58 is fastened to the fork bolt 40, rotation of the fork bolt 40 between an open and a closed position causes the link 58 to slide along wall 21 and move relative to the flexible member 74.

When the latch 10 is closed, as illustrated in FIG. 3, the fork bolt 40 is positioned to retain a striker in throat 48. In this position, the link 58 is at its furthest position from the angled surface 77 of the protruding portion 76 of the flexible member 74. In this position, the second end 60 is disengaged from the angled surface 77. Opening of the latch 10 causes rotation of the fork bolt 40 to release the striker. This initial rotation of the fourth shoulder 52 causes second end 60 of link 58 to move linearly in a direction towards the protruding portion 76. In the exemplary embodiment, the linear movement is guided by the contact of contact surface 61 with the wall 21. As the fork bolt 40 rotates to a position approximately half way between open and closed (see FIG. 4), the cam surface 63 slidably engages angled surface 77 of the protruding portion 76 of the flexible member 74. The movement of the second end 60 along angled surface 77, caused by the rotation of the fork bolt 40, creates a force acting on the protruding portion 76 that causes the free end of the flexible member 74 to rotate in the direction of switch 34 (e.g., first position towards second position). As the fork bolt 40 rotates further to a fully open position, as illustrated in FIG. 5, the link 58 connected to the fourth shoulder 52 of the fork bolt 40 similarly continues to move. This rotational movement causes the second end 60 of link 58 to apply a force on the flexible member 74 in the direction of the switch 34, such that the flexible member 74 in held in contact with the switch 34 when the latch 10 is open. Therefore, activation of the switch 34 is dependent on the state of the latch 10. Activation of the switch 34 causes a signal to be generated and provided to controller 31. In contrast and as the fork bolt moves from the open position to the closed position, the link 58 moves away from surface 77 of flexible member 74, the force is no longer applied and the flexible member 74 moves from the second position to the first position wherein the flexible member 74 no longer contacts switch 34. The switch may produce any of a number of signals including but not limited to a signal that a door is open. In one non-limiting embodiment, switch 34 has a protective covering 79 that is located over the plunger of the switch 34. In one non-limiting exemplary embodiment, protective covering 79 may be a silicon type material capable of having resilient qualities and being compressible by member 74 as the same is moved by cam surface 63 of link 58.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A latch comprising:

a housing having a wall;

a fork bolt operably coupled to the housing for movement between an unlatched position and a latched position;

a detent lever operably coupled to the housing and arranged to cooperate with the fork bolt;

a flexible member operably connected to the housing, the flexible member having a protruding portion proximate to a free end of the flexible member; and a link having a first end rotationally coupled to the fork bolt and a second end distal from the first end, the second distal end arranged to move linearly from a first position to a second position, wherein when the fork bolt is moved from the latched position to the unlatched position, the second distal end of the link contacts the wall as the link moves from the first position to the second position so as to apply a force to the flexible member, causing the flexible member to move from a first position to a second position.

2. The latch according to claim 1, further comprising a switch coupled to the housing such that movement of the flexible member into the second position activates the switch.

3. The latch of claim 2, wherein activation of the switch creates a latch open signal.

4. The latch according to claim 1, wherein the flexible member is integrally formed with the housing.

5. The latch according to claim 1, wherein the second distal end of the link includes a contact surface and an opposing cam surface, the cam surface being disposed to contact the protruding portion as the link moves from the first position to the second position, the contact surface contacting the wall as the link moves from the first position to the second position.

6. The latch according to claim 1, wherein the flexible member is made from a resilient material.

7. The latch according to claim 1, wherein the second distal end of the link is larger than the first end of the link.

8. A method for creating a signal comprising:

disengaging a detent lever from a fork bolt;

rotating the fork bolt from a first position to a second position after the detent lever has been disengaged from the fork bolt, wherein a link pivotally connected to the fork bolt moves linearly from a first position to a second position as the fork bolt rotates from the first position to the second position, and an end of the link moves between a wall of a housing, in which the detent lever and fork bolt are located, and a flexible member of the housing as the link moves from the first position to the second position;

moving the flexible member from a first position to second position via the end of the link as the link moves from the first position to the second position, wherein the end of the link contacts the wall and the flexible member as the link is moved from the first position to the second position;

activating a switch with the flexible member when the flexible member is moved into the second position by the link.

9. The method according to claim 8, wherein a cam surface of a rotary gear moves the detent lever out of engagement with the fork bolt.

10. The method according to claim 8, wherein a coil spring biases the fork bolt to the second position.

11. The method according to claim 8, wherein the end of the link includes a cam surface configured to contact a protruding portion of the flexible member as the link is moved from the first position to the second position.

12. The method according to claim 11, wherein the protruding portion of the flexible member is adjacent to the switch.

13. The method according to claim 8, wherein the end of the link is larger than an opposite end of the link pivotally connected to the fork bolt.

14. The method according to claim 8, wherein the flexible member is integrally formed with the housing.

15. The method according to claim 14, wherein the flexible member extends at an angle from the housing.

16. The method according to claim 8, wherein the flexible member is made of a resilient plastic material.

17. A latch comprising:

a housing having a wall and a flexible member, the flexible member having a distal end with an angled surface;

a fork bolt pivotally coupled to the housing and movable between an unlatched position and a latched position;

a detent lever pivotally coupled to the housing and arranged to cooperate with the fork bolt; and a link having a first end rotationally coupled to the fork bolt and a second end in slidable engagement with the wall, the link being arranged to move linearly from a first position to a second position in response to rotation of the fork bolt from the latched position and the unlatched position, wherein when the fork bolt is moved from the latched position to the unlatched position, a cam surface of the second end of the link contacts the angled surface of the flexible member as the second end contacts and slides along the wall, causing the flexible member to move from a first position to a second position.

18. The latch according to claim 17, further comprising a switch coupled to the housing such that movement of the flexible member into the second position activates the switch.

19. The latch of claim 18, wherein activation of the switch creates a latch open signal.

20. The latch as in claim 1, wherein the protruding portion further comprises an angled surface configured to engage a cam surface of the second end of the link.

* * * * *